US007041940B2

(12) United States Patent
Bakanowski et al.

(10) Patent No.: US 7,041,940 B2
(45) Date of Patent: May 9, 2006

(54) POWER MANAGEMENT SYSTEMS AND METHODS

(75) Inventors: Stephen Michael Bakanowski, Louisville, KY (US); David Laurence Kinny, Louisville, KY (US); Lawrence Michael Portaro, Louisville, KY (US); Timothy Francis Powell, Mentor, OH (US); Mark Patrick Schoenegge, Prospect, KY (US); Joshua Stephen Wiseman, Elizabethtown, KY (US); Charles Ray Smith, Shelbyville, KY (US); Cecilia Maria Blanchard, Louisville, KY (US)

(73) Assignee: General Electric Company, Schenectady, NY (US)

( * ) Notice: Subject to any disclaimer, the term of this patent is extended or adjusted under 35 U.S.C. 154(b) by 438 days.

(21) Appl. No.: 10/402,512

(22) Filed: Mar. 28, 2003

(65) Prior Publication Data

US 2005/0173401 A1 Aug. 11, 2005

(51) Int. Cl.
*H05B 1/02* (2006.01)

(52) U.S. Cl. ..... 219/412; 219/395; 219/485; 219/497; 219/486

(58) Field of Classification Search ..... None
See application file for complete search history.

(56) References Cited

U.S. PATENT DOCUMENTS

| | | | | |
|---|---|---|---|---|
| 2,932,715 | A * | 4/1960 | Weeks | 219/485 |
| 3,005,109 | A * | 10/1961 | Mearick et al. | 219/485 |
| 3,578,949 | A * | 5/1971 | Weyrick | 219/395 |
| 4,010,412 | A | 3/1977 | Forman | |
| 4,196,330 | A | 4/1980 | Payne | |
| 4,198,553 | A | 4/1980 | Dills | |
| 4,366,357 | A | 12/1982 | Satoh | |
| 4,469,926 | A | 9/1984 | Komuro | |
| 4,798,927 | A | 1/1989 | Kaminaka | |
| 4,880,954 | A | 11/1989 | Bennett et al. | |
| 6,157,008 | A | 12/2000 | Brown et al. | |
| 6,566,633 | B1 * | 5/2003 | Kitada | 219/486 |
| 6,700,101 | B1 * | 3/2004 | Decesari et al. | 219/485 |
| 6,841,760 | B1 * | 1/2005 | Whipple, Jr. | 219/395 |

FOREIGN PATENT DOCUMENTS

DE 2832059 A * 2/1979

* cited by examiner

*Primary Examiner*—Joseph Pelham
(74) *Attorney, Agent, or Firm*—H. Neil Houser, Esq.; Armstrong Teasdale LLP

(57) ABSTRACT

A cooking platform includes at least one surface heating element having a first power consumption level and an oven located under the surface heating element. The oven includes a first heating element having a second power consumption level and a second heating element having a third power consumption level. The second heating element has at least two heating sub-elements. One of the two heating sub-elements is configured to be deenergized when a sum of the first, second, and third power consumption levels exceeds a power consumption limit of the cooking platform.

25 Claims, 7 Drawing Sheets

POWER MANAGEMENT SYSTEMS AND METHODS

BACKGROUND OF THE INVENTION

This invention relates generally to power management systems and methods, and more particularly, to power management systems and methods for cooking platforms.

There exist different types of cooking platforms which incorporate various appliances that can be activated individually or simultaneously. For example, a typical electric household range includes an oven and generally four surface heating elements. Once the cooking platform is connected within a household, there will be a preset power supply limit available for use by the cooking platform. In most instances, there exist building codes which must be adhered to in wiring for such a cooking platform such that the available power supply is typically pre-established.

With the above in mind, appliances have associated power consumption levels that should not collectively exceed the available power supply to the cooking platform. In this manner, it is assured that all of the appliances in the cooking platform can be simultaneously activated without overloading the electrical circuitry and blowing a fuse. However, from a practical standpoint, it is actually quite rare that all of the appliances will require activation at the same time.

Certainly, some versatility and other benefits can be made available to a consumer if the cooking platform were to incorporate either additional high powered appliances, even if these appliances were to collectively exceed the available power supply limit if simultaneously activated. For instance, in the case of an electric household range, it may be advantageous to increase the available upper power input for the oven and/or the surface burners, or to even incorporate a second oven unit as part of the overall range. Without correspondingly decreasing the power rating of the individual appliances to safeguard against a system overload, these design changes are typically not available.

BRIEF SUMMARY OF THE INVENTION

In one aspect, a cooking platform includes at least one surface heating element having a first power consumption level and an oven located under the surface heating element. The oven includes a first heating element having a second power consumption level and a second heating element having a third power consumption level. The second heating element has at least two heating sub-elements. One of the two heating sub-elements is configured to be deenergized when a sum of the first, second, and third power consumption levels exceeds a power consumption limit of the cooking platform.

In another aspect, a cooking platform includes a first appliance having a first power consumption level. Moreover, the cooking platform includes a primary element of a second appliance of the platform having a second power consumption level and an auxiliary element of the second appliance having a third power consumption level. A controller is coupled to the first appliance, the primary element, and the auxiliary element. The controller is configured to maintain the auxiliary element deenergized when a sum of the first, second, and third power consumption levels exceeds a power consumption limit of the cooking platform.

In yet another aspect, a method for managing power in a cooking platform includes determining a sum of a first power consumption level of at least one surface heating element of the cooking platform, a second power consumption level of a first heating element of the cooking platform, and a third power consumption level of a second heating element of the cooking platform. Moreover, the method includes deenergizing one of multiple heating sub-elements of the first heating element if the sum exceeds a power consumption limit of the cooking platform.

In still another aspect, a method for managing power in a cooking platform includes determining a sum of a first power consumption level of a first appliance of the cooking platform, a second power consumption level of a primary element of a second appliance of the cooking platform, and a third power consumption level of an auxiliary element of the second appliance. Moreover, the method includes determining whether the sum exceeds a power consumption limit of the platform. Furthermore, the method includes energizing the primary and auxiliary elements if the sum does not exceed the power consumption limit.

DETAILED DESCRIPTION OF THE INVENTION

Figure 1:
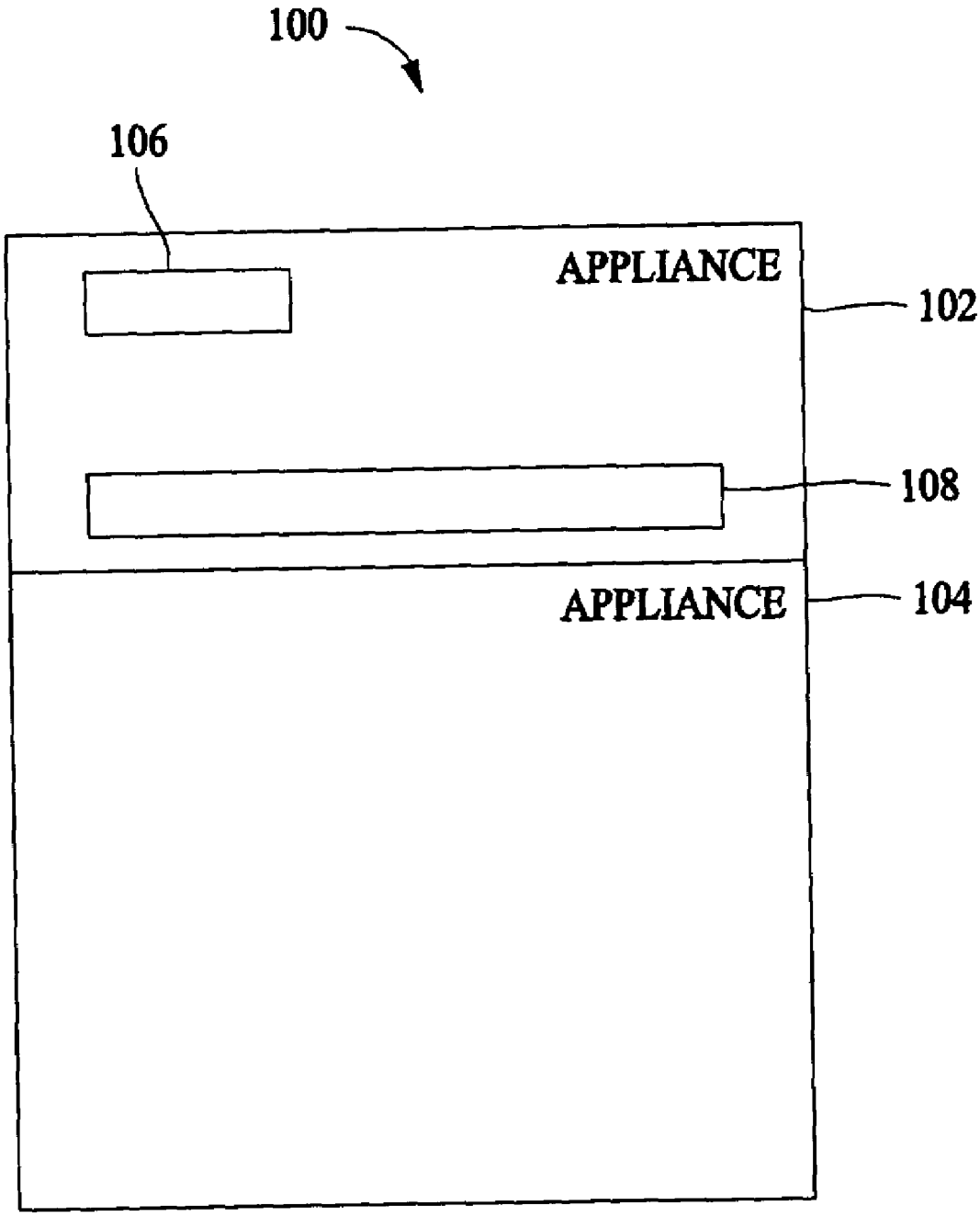
FIG. 1 is a block diagram of an embodiment of a cooking platform in which a power management system and method is implemented.

FIG. 1 is a block diagram of an embodiment of a cooking platform 100 in which a power management system and method as described herein is implemented. The power management system and method is described below in detail. Cooking platform 100 has an appliance 102 and an appliance 104 located below appliance 102. Examples of appliance 102 include a speedcooking oven, a convection oven, and at least one surface heating element. An illustration of the speedcooking oven includes an Advantium™ that is manufactured by General Electric Appliances, Louisville, Ky. Another illustration of the speedcooking oven is described below. A convection oven has a convection fan, which is used to distribute hot air around food to cook the food. A wall oven is one example of a convection oven. Appliance 102 includes an element 106, which can be, for instance, a magnetron, a surface heating element, or a broil heating element. Appliance 102 also includes a heating element 108, which can be, for instance, a surface heating element, or a bake heating element. Appliance 104 can be, for instance, a speedcooking oven or a convection oven. Cooking platform 100 can also have a third appliance, such as, for instance, a warming drawer, which can be located below appliance 104. A warming drawer is used to heat various items, such as food and plates.

Figure 2:
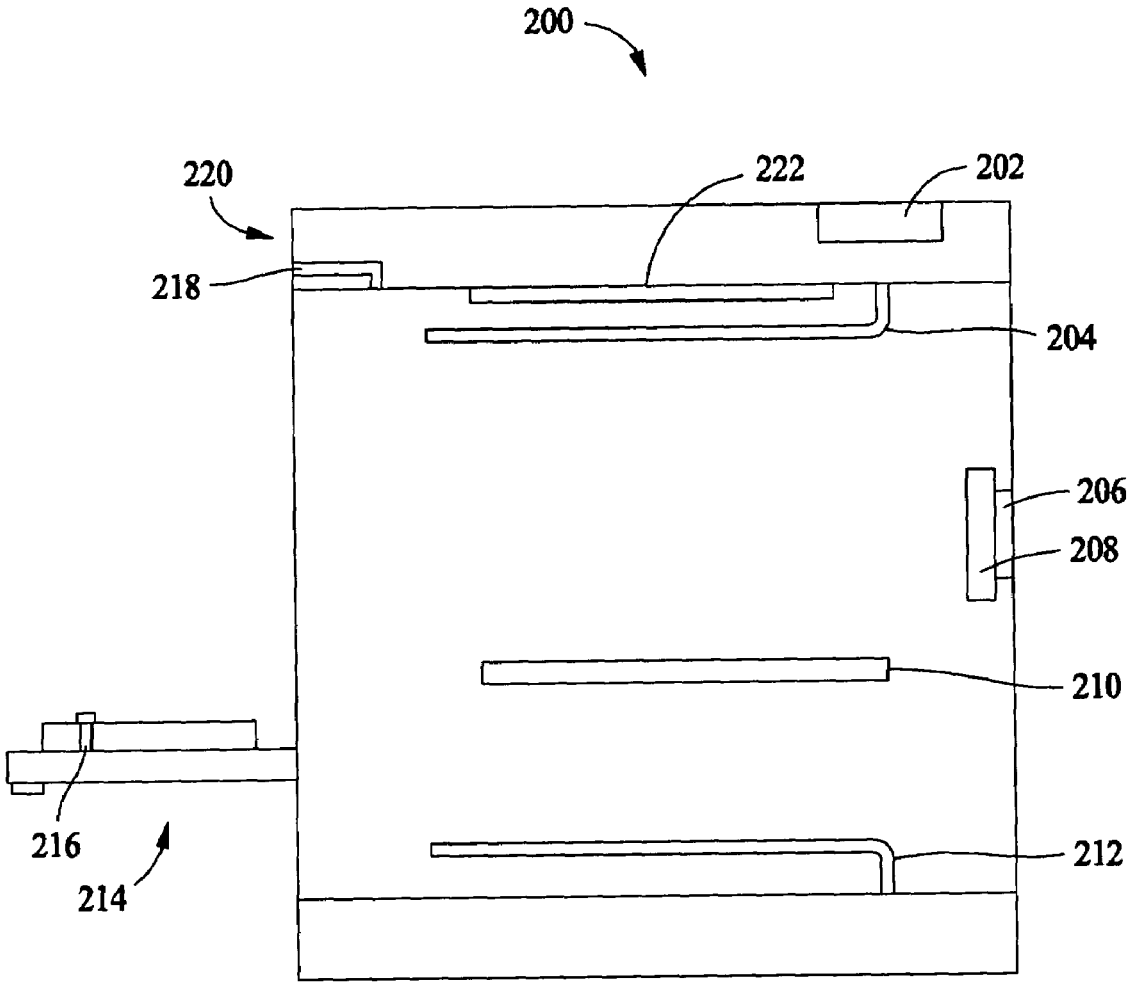
FIG. 2 is a side view of an embodiment of a speedcooking oven in which a power management system and method is implemented.
Figure 3:
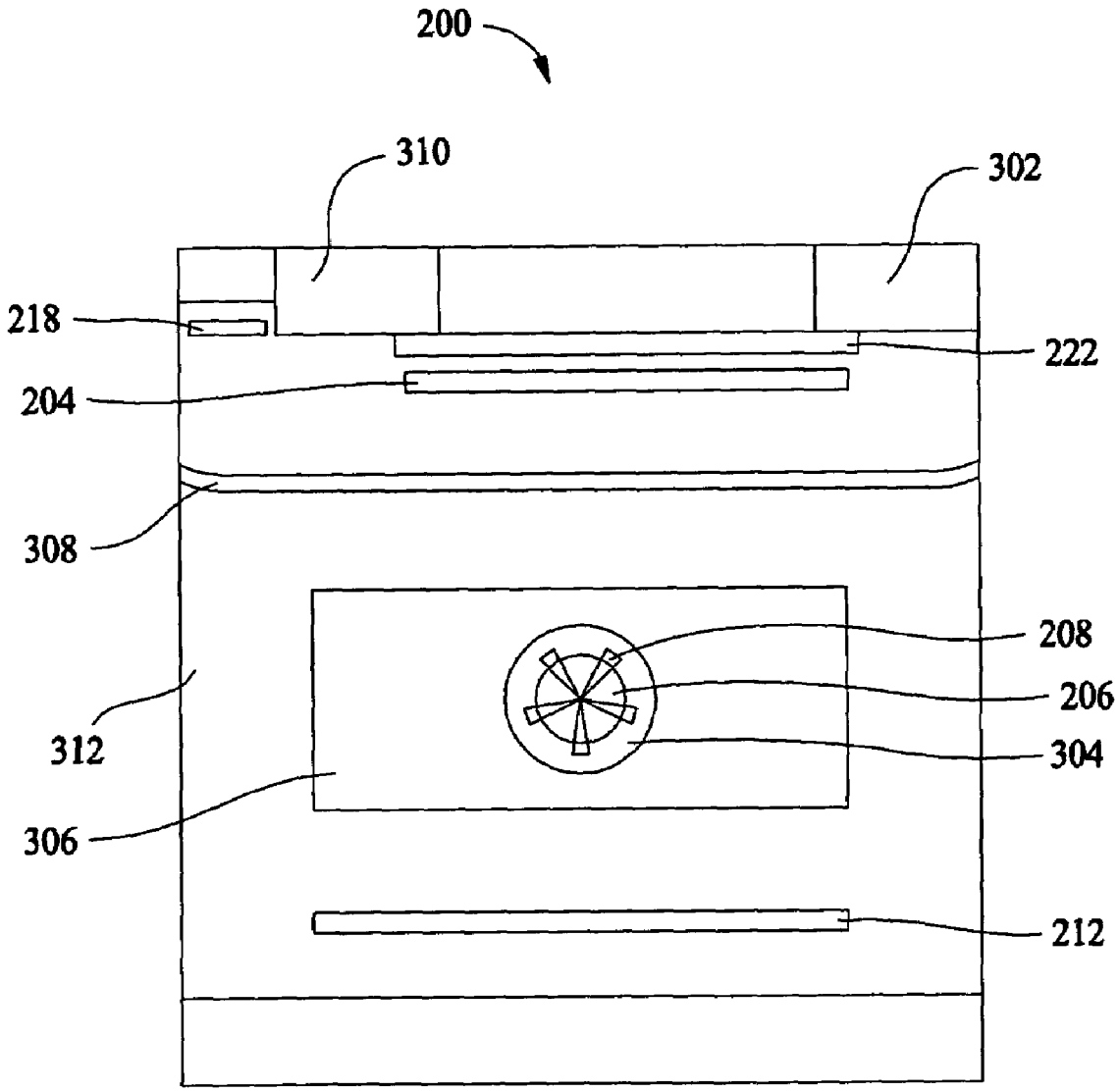
FIG. 3 is a front view of the embodiment of the speedcooking oven.

FIG. 2 is a side view of an embodiment of a speedcooking oven 200 in which the herein described power management system and method is implemented. The power management system and method can also be implemented in other ovens, such as, for instance, a convection oven. FIG. 3 is front view of the embodiment of speedcooking oven 200. Speedcooking oven 200 has a broil heating element 204, a bake heating element 212, a convection heating element 206, a convection fan 208, a magnetron 202, and a rack 210. Broil heating element 204 is located at a top end inside speedcooking oven 200 and bake heating element 212 is located at a bottom end inside speedcooking oven 200. Convection heating element 206 and convection fan 208 are located at a back end inside speedcooking oven 200. A cover 304 is provided to shield a user from convection heating element 206 and convection fan 208. Magnetron 202 is located above broil heating element 204 and inside speedcooking oven 200.

Magnetron 202 generates microwave energy to speed cook various food items, which are supported by rack 210. The microwaves are evenly distributed inside speedcooking oven 200 by a microwave disbursement plate 222 that lies between magnetron 202 and broil heating element 204. However, microwaves cannot brown the food items. Heating elements 204, 206, and 212 provide thermal energy that circulates inside speedcooking oven 200 to brown the food. The thermal energy circulates quickly when fan 208 is energized. Air inside speedcooking oven 200 is removed from speedcooking oven 200 via a vent 218.

A door 312 of speedcooking oven 200 allows access to speedcooking oven 200. Door 312 has an interlock 216 that prevents the user from opening door 312 when speedcooking oven 200 is energized. For instance, speedcooking oven 200 is deenergized when the user opens door 312 during a speedcooking operation. A handle 308 is used to open door 312. A window 306 located on door 312 allows the user to see the food that is placed inside speedcooking oven 200.

An alphanumeric menu display 310 of speedcooking oven 200 allows the user to choose between various functions that speedcooking oven 200 performs. For example, the user can use alphanumeric display 310 to speedcook vegetable lasagna. A status display 302 notifies the user of various conditions inside speedcooking oven 200. As an instance, status display 302 can notify the user that the temperature inside speedcooking oven 200 is 327 degrees Fahrenheit.

Figure 4:
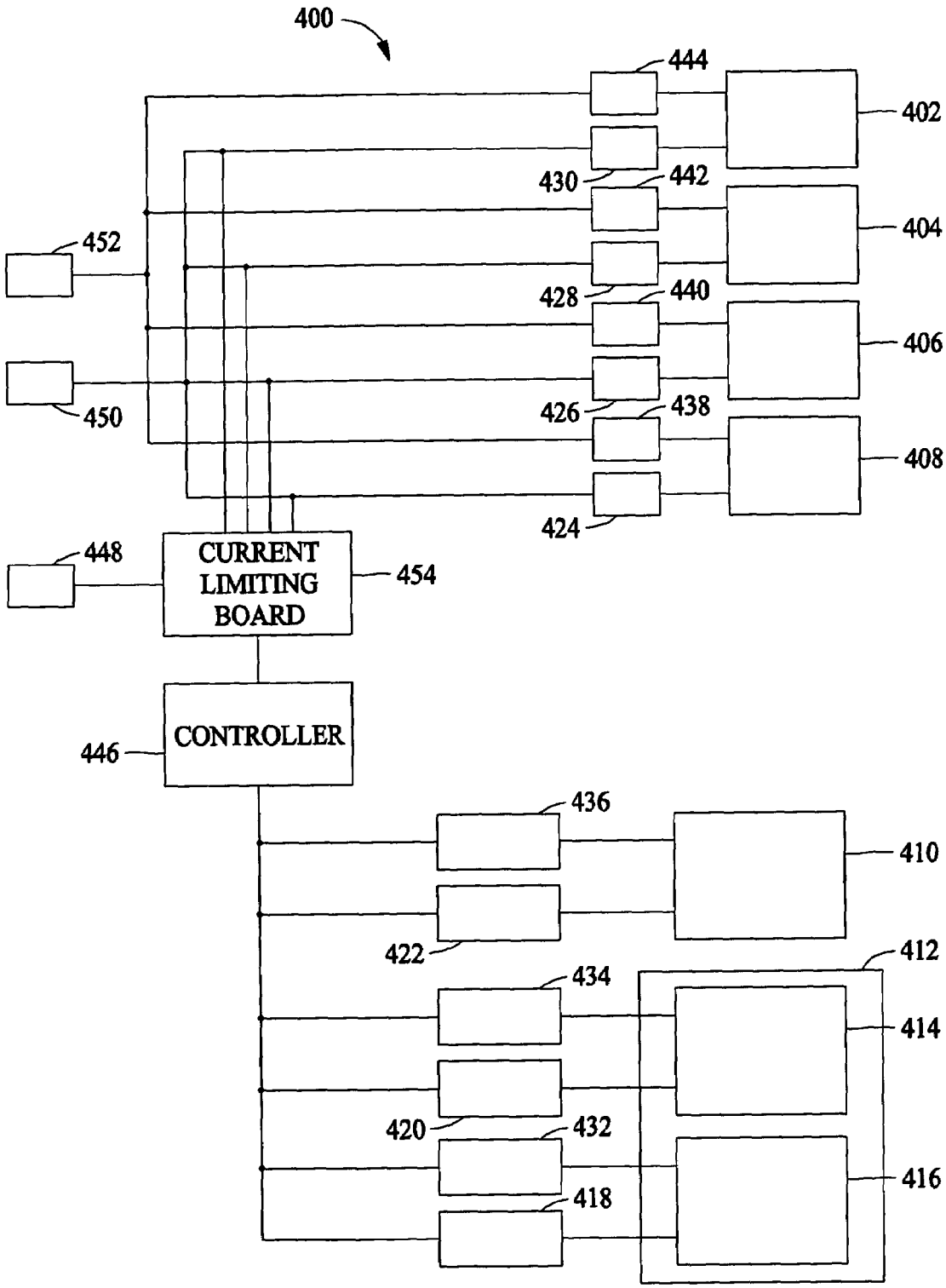
FIG. 4 is a functional block diagram of an embodiment of a power management system that is implemented in the speedcooking oven.

FIG. 4 is a functional block diagram of an embodiment of a power management system 400 that is implemented in an appliance, such as speedcooking oven 200. Power management system 400 has at least one surface heating element, such as surface heating elements 402–408. Moreover, power management system 400 has a heating element 410, a heating element 412, a controller 446, sensors 432–444, and switches 418–430. Heating element 410 can be, for instance, a convection heating element having a power consumption level of 2500 watts and heating element 412 is, for instance, a bake heating element having a power consumption level of 3400 watts. The power consumption levels of 2500 watts of the convection heating element and 3400 watts of the bake heating element are empirical data derived from experimentation. Alternatively, heating element 410 is, for example, a broil heating element. Heating element 412 is split into least two heating sub-elements, a heating sub-element 414 and a heating sub-element 416. Heating sub-element 414 has a higher power consumption level than heating sub-element 416. To illustrate, heating element 412 is split such that heating sub-element 414 can have a power consumption level of 2500 watts and heating sub-element 416 can have a power consumption levels of 900 watts. The power consumption level of 2500 watts of heating sub-element 414 and the power consumption level of 900 watts of heating sub-element 416 are empirical data derived from experimentation in which heating element 412 is a bake heating element. As another illustration, heating element 412 is split such that heating sub-element 414 can have a power consumption level of 2000 watts and heating sub-element 416 can have a power consumption levels of 1400 watts. Heating element 410 is coupled via switch 422 to controller 446 and is coupled via sensor 436 to controller 446. Similarly, heating sub-element 414 is coupled via switch 420 to controller 446 and is coupled via sensor 434 to controller 446. Similarly, heating sub-element 416 is coupled via switch 418 to controller 446 and is coupled via sensor 432 to controller 446. Alternatively, both heating sub-elements 414 and 416 are coupled via one sensor to controller 446.

Each surface heating element 402–408 is coupled via a switch to a current limiting board 454 and is coupled via a sensor to current limiting board 454. For instance, surface heating element 402 is coupled via switch 430 to current limiting board 454 and is coupled via sensor 444 to current limiting board 454. Current limiting board 454 is used to convert a high voltage signal, such as, for instance, a 120 volt signal, to a low voltage signal. Current limiting board 454 may not be used if there is no need for the conversion. Power supply 448 supplies the high voltage signal. Each surface heating element 402–408 is coupled via a switch to a power supply. For example, surface heating element 402 is coupled via switch 430 to power supply 450. Each surface heating element 402–408 is coupled via a sensor to a power supply. As an illustration, surface heating element 402 is coupled via sensor 444 to power supply 452.

The user operates an appliance, such as speedcooking oven 200, having power management system 400, in a particular mode of operation. Different types of modes include, for instance, a preheat mode, a bake mode, and broil mode, and a speedcooking mode. During the mode of operation, switch 422 is on so that heating element 410 is energized by power supply 448. Moreover, switch 420 is on so that heating sub-element 414 is energized by power supply 448. Furthermore, switch 418 is on so that heating sub-element 416 is energized by power supply 448. Additionally, switches 428–430 are on so that surface heating elements 402–404 are energized by power supply 450. When the user energizes surface heating element 406 from power supply 450, controller 446 executes a power management method. Alternatively, controller 446 executes the power management system when the user energizes any of surface heating elements 402–408. Any of surface heating elements 402–408 are energized by changing any of the corresponding switches from an off position to an on position. To illustrate, surface heating element 402 is energized by changing switch 430 from an off position to an on position.

The power management method is an algorithm to determine whether a sum of a power consumption level of heating element 410, a power consumption level of heating element 412, and a power consumption level of surface heating elements 402–408 exceed a power consumption limit of an appliance, such as, for example, speedcooking oven 200, having power management system 400. During the execution of the power management method, controller 446 obtains the power consumption level of heating element 410 from sensor 436, the power consumption level of heating sub-element 414 from sensor 434, and the power consumption level of heating sub-element 416 from sensor 432. Moreover, controller 446 senses a power consumption level of a surface heating element via a sensor that is coupled to the surface heating element. To illustrate, controller 446 senses the power consumption level of surface heating element 402 via sensor 430. Then controller 446 sums the obtained power consumption levels. If controller 446 determines that the sum exceeds the power consumption limit of the appliance by a small amount, controller 446 deenergizes heating sub-element 416 since heating sub-element 416 has a lower power consumption level than the power consumption level of heating sub-element 414. For example, if in addition to heating element 410 and heating sub-elements 414 and 416, only three surface heating elements out of four surface heating elements 402–408 are energized, the power consumption limit of the appliance is exceeded by a small amount of 800 watts. So, in the example, controller 446 deenergizes heating sub-element 416 that has a power consumption of 900 watts instead of deenergizing heating sub-element 414 that has a power consumption level of 2500 watts. Heating sub-element 416 is deenergized by changing switch 418 to an off position. As soon as heating sub-element 416 is deenergized, the sum does not exceed the power consumption limit. As another example, if in addition to heating element 410 and heating sub-elements 414 and 416, only three surface heating elements out of four surface heating elements 402–408 are energized, the power consumption limit of the appliance is exceeded by a small amount of 900 watts. So, controller 446 deenergizes heating sub-element 416 that can have a power consumption of 1400 watts instead of deenergizing heating sub-element 414 that can have a power consumption level of 2000 watts. As soon as heating sub-element 416 is deenergized, the sum does not exceed the power consumption limit.

Alternatively, if controller 446 determines that the sum exceeds the power consumption limit by a large amount, controller 446 deenergizes heating sub-element 414 since heating sub-element 414 has a higher power consumption level than heating sub-element 416. For example, if in addition to heating element 410 and heating sub-elements 414 and 416, all four of surface heating elements 402–408 are energized, the power consumption limit of the appliance is exceeded by a large amount of 2400 watts. So, in the example, controller 446 deenergizes heating sub-element 414 that has a power consumption level of 2500 watts instead of deenergizing heating sub-element 416 that has a power consumption level of 900 watts. Heating sub-element 414 is deenergized by changing switch 420 to an off position. As soon as heating sub-element 414 is deenergized, the sum does not exceed the power consumption limit. As another instance, if in addition to heating element 410 and heating sub-elements 414 and 416, all four of surface heating elements 402–408 are energized, the power consumption limit of the appliance is exceeded by a large amount of 1900 watts. So, controller 446 deenergizes heating sub-element 414 that has a power consumption level of 2000 watts instead of deenergizing heating sub-element 416 that has a power consumption level of 1400 watts. As soon as heating sub-element 414 is deenergized, the sum does not exceed the power consumption limit.

If controller 446 determines that the sum does not exceed the power consumption limit of the appliance, controller 446 maintains the status quo at the time of calculation of the sum. For example, if in addition to heating element 410 and heating sub-elements 414 and 416, only two of four surface heating elements 402–408 are energized, the power consumption limit of the appliance is not exceeded. So, controller 446 does not deenergize any of heating sub-elements 414–416. At the end of the mode of operation, controller 446 deenergizes heating element 410, any of heating sub-elements 414–416 that are energized, and any of surface heating elements 402–408 that are energized.

Figure 5:
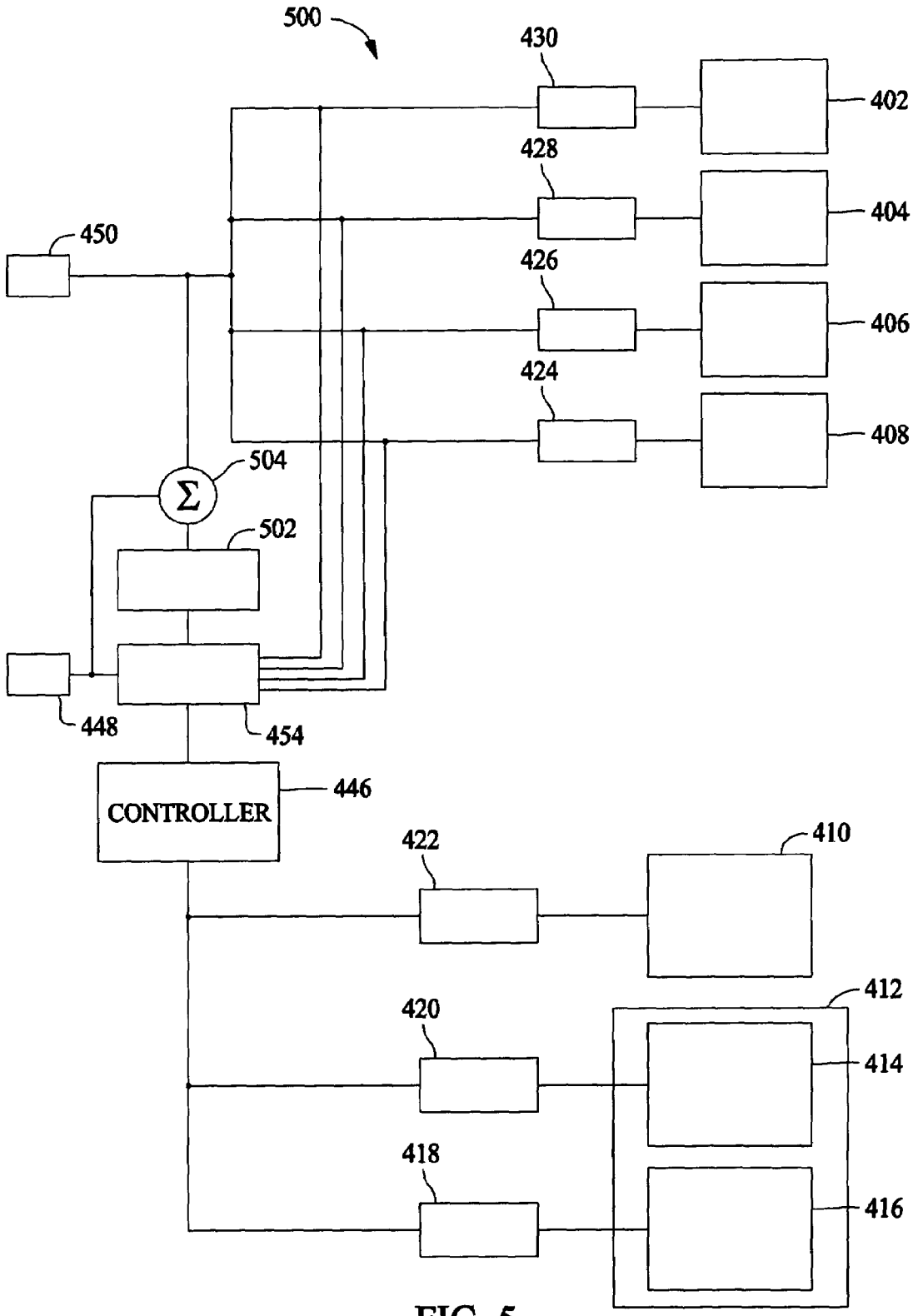
FIG. 5 is a functional block diagram of another embodiment of a power management system that is implemented in the speedcooking oven.

FIG. 5 is a functional block diagram of another embodiment of a power management system 500. Power management system 500 shown in FIG. 5 is similar to power management system 400 shown in FIG. 4, and components in power management system 500 that are identical to components in power management system 400 are identified in FIG. 5 using the same reference numerals used in FIG. 4. However, there are a few differences between power management system 500 and power management system 600. Power supply 452 is removed. Sensors 432–444 are removed and are replaced by a sensor 502. Sensor 502 is coupled to current limiting board 454. Current limiting board 454 may not be used if there is no need to convert a high voltage signal to a low voltage signal. An adder 504 is coupled to power supplies 448–450 and to sensor 502.

A power management method that is executed by power management system 500 is similar to the power management method that is executed by power management system 400 except for a few changes. Controller 446 does not separately obtain the power consumption levels of surface heating elements 402–408, heating element 410, heating sub-element 414, and heating sub-element 416. Instead, controller 446 obtains the sum of power consumption levels of surface heating elements 402–408, heating element 410, heating sub-element 414, and heating sub-element 416. Adder 504 adds the power consumption levels of surface heating elements 402–408, heating sub-elements 414–416, and heating element 410 to provide the sum to sensor 502. Sensor 502 senses the sum and provides the sum to controller 446. Controller 446 determines whether the sum exceeds a power consumption limit of an appliance, such as speedcooking oven 200, in which power management system 500 is implemented.

Figure 6:
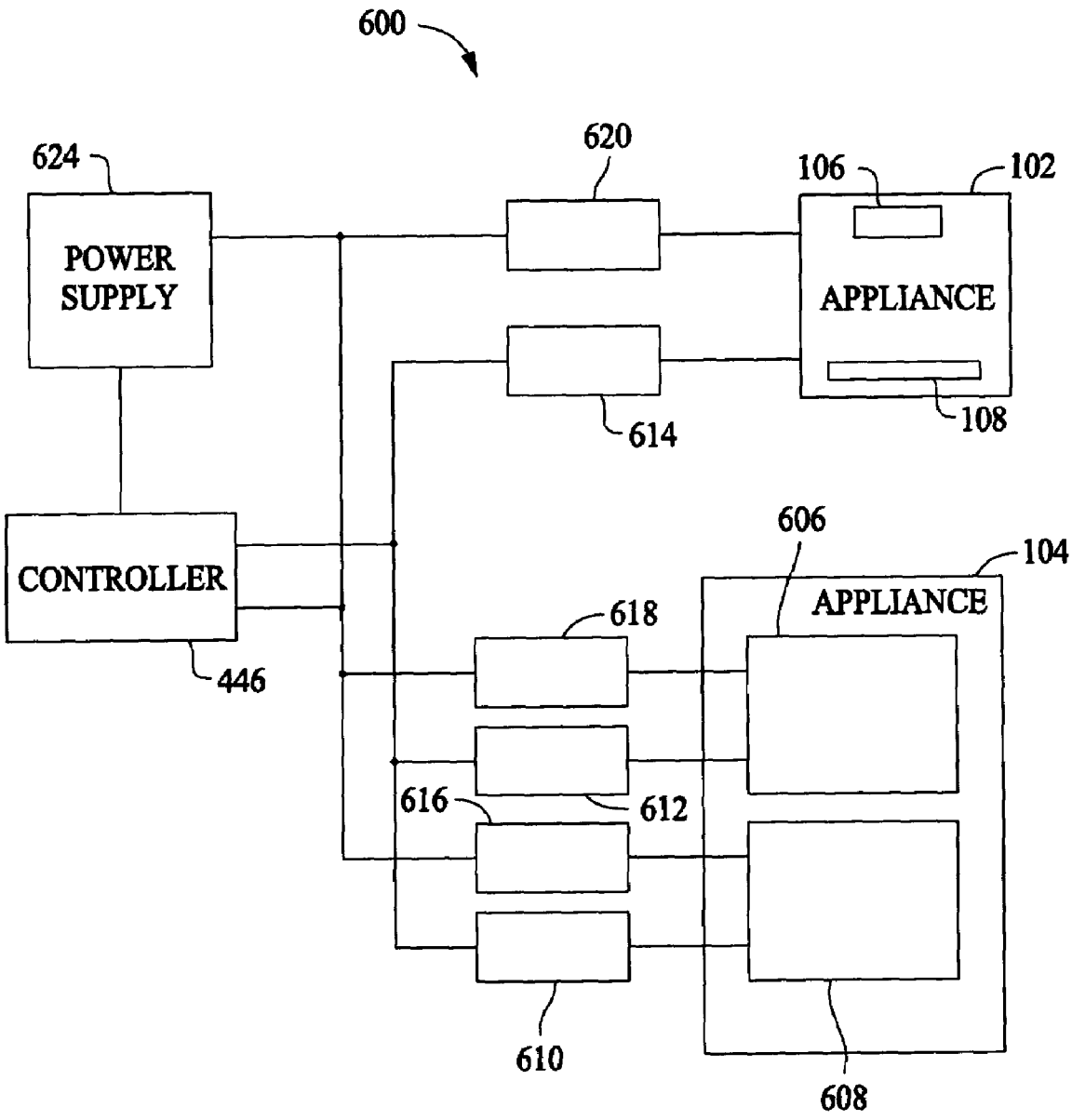
FIG. 6 is a functional block diagram of yet another embodiment of a power management system that is implemented in the cooking platform.

FIG. 6 is a functional block diagram of yet another embodiment of a power management system 600 that is implemented in cooking platform 100. Power management system 600 has controller 446, sensors 616–620, switches 610–614, appliance 102, and appliance 104. Power management system 600 can have a higher number of appliances. Appliance 104 has at least one primary element 606 and at least one auxiliary element 608. An example of primary element 606 is heating sub-element 414 and an example of the auxiliary element 608 is heating sub-element 416. Appliance 102 is coupled via switch 614 to controller 446 and is coupled via sensor 620 to controller. Similarly, primary element 606 is coupled via switch 612 to controller 446 and is coupled via sensor 618 to controller. Similarly, auxiliary element 608 is coupled via switch 610 to controller 446 and is coupled via sensor 616 to controller. A power supply 624 is coupled to controller 446. Power supply 624 is also coupled to appliance 102 via switch 614, to primary element 606 via switch 612, and to auxiliary element 608 via switch 610.

The user operates appliance 102 in a particular mode of operation. Different types of modes were described above. During the mode of operation, switch 614 is on so that appliance 102 is energized by power supply 624. When the user manipulates a user interface of cooking platform 100 having power management system 600 to energize, appliance 104, controller 446 executes a power management method. Primary element 606 of appliance 104 is energized when switch 612 changes to an on position. Similarly, auxiliary element 608 of appliance 608 is energized when switch 610 changes to an on position.

The power management method is an algorithm to determine whether a sum of a power consumption level of appliance 102, a power consumption level of primary element 606, and a power consumption level of auxiliary element 608 exceeds a power consumption limit of cooking platform 100 having power management system 600. During the execution of the power management method, controller 446 obtains the power consumption level of appliance 102 from sensor 620, the power consumption level of primary element 606 from sensor 618, and the power consumption level of auxiliary element 608 from sensor 616. Then controller 446 sums the obtained power consumption levels. If controller 446 determines that the sum is above the power consumption limit of the cooking platform 100, controller 446 energizes primary element 606 and does not energize auxiliary element 608. For example, appliance 102 is an Advantium™. When energized, the Advantium™ can have a power consumption level corresponding to an ampere circuit rating of 29 amperes. Moreover, in the example, appliance 104 is a wall oven having a power consumption level corresponding to an ampere circuit rating of 15 amperes. Typically, cooking platform 100, in most households, has a power consumption limit that corresponds to an ampere circuit rating of 40 amperes. When the Advantium™ is energized and the user manipulates the user interface to energize the wall oven, controller 446 determines that the sum of power consumption level of the Advantium™ and the power consumption level of the wall oven, which corresponds to the ampere circuit rating of 44 amperes, is above the power consumption limit that corresponds to the ampere circuit rating of 40 amperes. Thus, controller 446 energizes primary element 606 of the wall oven and does not energize auxiliary element 608 of the wall oven. When appliance 102 is energized, primary element 606 is energized, and auxiliary element 608 is not energized, the sum does not exceed the power consumption limit.

Alternatively, if controller 446 determines that the sum is below the power consumption limit, controller 446 energizes primary element 606 and energizes auxiliary element 608. For example, appliance 102 is an Advantium™ and the user deenergizes the Advantium™. When deenergized, the Advantium™ can have a power consumption level corresponding to an ampere circuit rating of 0 amperes. Moreover, in the example, appliance 104 is a wall oven having a power consumption level corresponding to an ampere circuit rating of 15 amperes. Typically, cooking platform 100, in most households, has a power consumption limit that corresponds to an ampere circuit rating of 40 amperes. When the Advantium™ is deenergized and the user manipulates the user interface to energize the wall oven, controller 446 determines that the sum of power consumption levels of the Advantium™, the power consumption level of primary element 606, and the power consumption level of auxiliary element 608, which corresponds to the ampere circuit rating of 15 amperes, is below the power consumption limit that corresponds to the ampere circuit rating of 40 amperes. Thus, controller 446 energizes primary element 606 and auxiliary element 608 of the wall oven. When appliance 102 is not energized, primary element 606 is energized, and auxiliary element 608 is energized, the sum does not exceed the power consumption limit.

At the end of the mode of operation, controller 446 deenergizes any of appliances 102–104 or any of elements 606–608 that are energized. For instance, at the end of the mode of operation, if appliance 102 and primary element 606 are energized, controller 446 deenergizes appliance 102 and primary element 606. It is noted that the power management method is used to manage power between any number of appliances of cooking platform 100.

Figure 7:
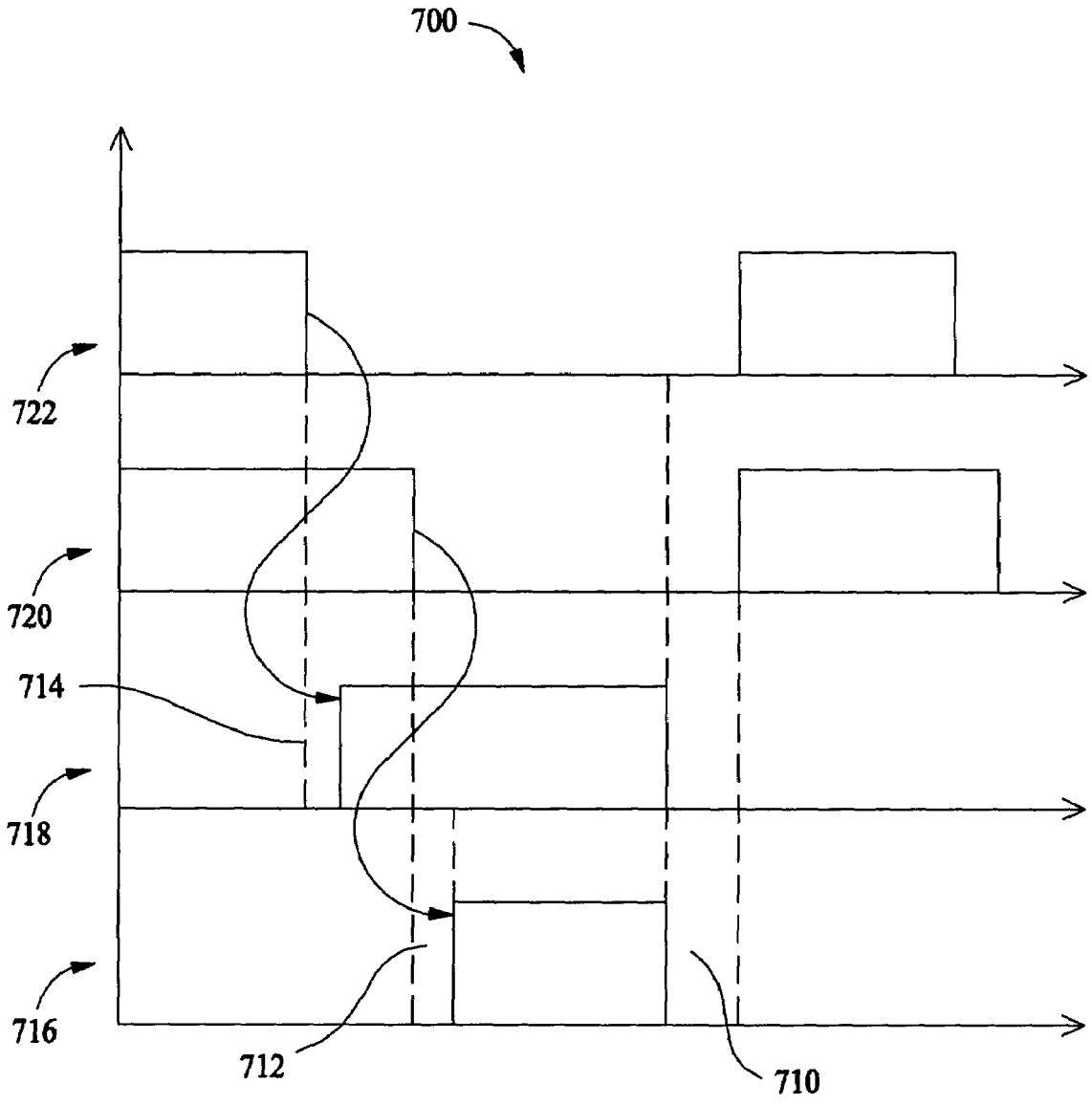
FIG. 7 is a timing diagram of an embodiment of a power management method that is executed by the power management system of FIG. 6.

FIG. 7 is a timing diagram of an embodiment of the power management method that is executed by power management system 600. A timing sub-diagram 722 shows whether element 106 of appliance 102 is energized at a particular time. A timing sub-diagram 720 shows whether heating element 108 of appliance 102 is energized at a particular time. A timing sub-diagram 718 shows whether primary element 606 of appliance 104 is energized at a particular time. A timing sub-diagram 716 shows whether auxiliary element 608 of appliance 104 is energized at a particular time.

When both element 106 and heating element 108 of first appliance 102 are energized as shown by timing sub-diagrams 720–722, and the user uses the user interface to energize primary and auxiliary elements 606–608, controller 446 determines that a sum of power consumption levels of element 106, heating element 108, primary element 606, and auxiliary element 608 exceeds a power consumption limit of cooking platform 100 having power management system 600. Therefore, controller 446 energizes primary element 606 as evident from timing sub-diagram 718 and does not energize auxiliary element 608 as evident from timing sub-diagram 716. When both element 106 and heating element 108 of appliance 102 are not energized as shown by timing sub-diagrams 720–722, and the user uses the user interface to energize primary element 606 and auxiliary element 608, controller 446 determines that the sum of power consumption levels of element 106, heating element 108, primary element 606, and auxiliary element 608 is below a power consumption limit of cooking platform 100. Therefore, controller 446 energizes primary element 606 as evident from timing sub-diagram 718 and energizes auxiliary element 608 as evident from timing sub-diagram 716. Margins 710–714 show a lag time between the deenergizing of an element and the energizing of another element to ensure that the sum of the power consumption levels do not exceed the power consumption limit. For example, margin 714 shows a lag time between deenergizing of element 106 and energizing of primary element 606. Margins 710–714 also show the processing times of controller 446.

Hence, the power management systems and methods allow the user to efficiently manage power between appliances 102 and 104 in cooking platform 100. Moreover, the power management systems and methods allow the user to efficiently manage power in an appliance, such as speed-cooking oven 200. The power management systems and methods ensure that power consumption levels of appliances 102 and 104 do not exceed the power consumption limit of cooking platform 100. Moreover, the power management systems and methods ensure that power consumption levels of electrical devices inside an appliance, such as speedcooking oven 200, do not exceed the power consumption limit of the appliance.

While the invention has been described in terms of various specific embodiments, those skilled in the art will recognize that the invention can be practiced with modification within the spirit and scope of the claims.

What is claimed is:

1. A cooking platform having a power consumption limit, the cooking platform comprising:

at least one surface heating element having a first power consumption level; and an oven located under the surface heating element, the oven comprising:

a first heating element having a second power consumption level;

a second heating element having a third power consumption level, the second heating element comprising at least two heating sub-elements, a first heating sub-element of the two heating sub-elements configured to be deenergized when a sum of the first, second, and third power consumption levels exceeds the power consumption limit, wherein the first heating sub-element has a fourth power consumption level and a second heating sub-element of the two heating sub-elements has a fifth power consumption level; and a controller configured to determine whether the sum exceeds the power consumption limit by an amount between the fourth and fifth power consumption levels.

2. A cooking platform in accordance with claim 1 wherein the first heating element is coupled to a controller via a first switch, the first heating sub-element is coupled to the controller via a second switch, the second heating sub-element is coupled to the controller via a third switch, the surface heating element is coupled to the controller via a fourth switch, and the controller is coupled to a sensor for determining whether the sum of the first, second, and third power consumption levels exceeds the power consumption limit.

3. A cooking platform in accordance with claim 1 wherein the oven is a speedcooking oven, the first heating element is a broil heating element, the second heating element is a bake heating element.

4. A cooking platform in accordance with claim 1 wherein the power consumption limit corresponds to a forty ampere circuit rating.

5. A cooking platform in accordance with claim 1 wherein the fifth power consumption level is greater than the fourth power consumption level, and said controller configured to determine whether the sum exceeds the power consumption limit by an amount less than the fourth power consumption level, and said controller configured to deenergize the first heating sub-element upon determining that the sum exceeds the power consumption limit by the amount less than the fourth power consumption level.

6. A cooking platform in accordance with claim 1 wherein the fifth power consumption level is greater than the fourth power consumption level, and said controller configured to deenergize the second heating sub-element upon determining that sum exceeds the power consumption limit by the amount between the fourth and fifth power consumption levels.

7. A cooking platform having a power consumption limit, the cooking platform comprising:

at least one surface heating element having a first power consumption level; and an oven located under the surface heating element, the oven comprising:

a first heating element having a second power consumption level; and a second heating element having a third power consumption level, the second heating element comprising at least two heating sub-elements, one of the two heating sub-elements configured to be deenergized when a sum of the first, second, and third power consumption levels exceeds the power consumption limit, wherein the first heating element is coupled to a controller via a first sensor, the first heating sub-element is coupled to the controller via a second sensor, the second heating sub-element is coupled to the controller via a third sensor, the surface heating element is coupled to the controller via a fourth sensor, and the controller is configured to determine whether the sum of the first, second, and third power levels exceed the power consumption limit.

8. An oven located under a surface heating element, the surface element having a first power consumption level, the oven comprising:

a broil heating element having a second power consumption level; and a bake heating element having a third power consumption level, the bake heating element comprising at least two heating sub-elements, a first heating sub-element of the two heating sub-elements configured to have a higher power consumption level than a power consumption level of a second heating sub-element of the two heating sub-elements, wherein a controller is coupled to the surface heating element, the broil heating element, the first heating sub-element, and the second heating sub-element, the controller configured to determine an amount by which a sum of the first, second, and third power consumption levels exceeds a power consumption limit of the oven.

9. An oven in accordance with claim 8, wherein the controller is further configured to deenergize one of the two heating sub-elements based on the amount.

10. An oven in accordance with claim 9, wherein the power consumption level of the first heating sub-element is 2500 watts, the power consumption level of the second heating sub-element is 900 watts, the amount is 800 watts, the controller deenergizes the second heating sub-element and maintains to energize the first heating sub-element.

11. A cooking platform having a power consumption limit, the cooking platform comprising:

a first appliance having a first power consumption level;

a primary element of a second appliance of the platform, the primary element having a second power consumption level;

an auxiliary element of the second appliance, the auxiliary element having a third power consumption level; and a controller coupled to the first appliance, the primary element, and the auxiliary element, the controller configured to maintain the auxiliary element deenergized when a sum of the first, second, and third power consumption levels exceeds the power consumption limit, wherein said controller configured to determine whether the sum exceeds the power consumption limit by an amount between the second and third power consumption levels.

12. A cooking platform in accordance with claim 11 wherein the controller is further configured to energize the primary and auxiliary elements when the sum does not exceed the power consumption limit.

13. A cooking platform in accordance with claim 12 wherein the first appliance is one of an oven and a surface heating element.

14. A cooking platform in accordance with claim 13 wherein the oven is one of a speedcook oven and a convection oven, and the second appliance is an oven.

15. A cooking platform in accordance with claim 14 wherein the second appliance is one of a speedcooking oven and a convection oven.

16. A cooking platform in accordance with claim 11 wherein the power consumption limit corresponds to an ampere circuit rating of 40 amperes.

17. A method for managing power in a cooking platform, the method comprising:

determining a sum of a first power consumption level of at least one surface heating element of the cooking platform, a second power consumption level of a first heating element of the cooking platform, and a third power consumption level of a second heating element of the cooking platform;

deenergizing one of multiple heating sub-elements of the first heating element if the sum exceeds a power consumption limit of the cooking platform; and determining whether the sum exceeds the power consumption limit by an amount between a fourth power consumption level of a first one of the heating sub-elements and a fifth power consumption level of a second one of the heating sub-elements.

18. A method in accordance with claim 17 further comprising sensing the first, second, and third power consumption levels.

19. A method in accordance with claim 17 further comprising sensing the sum of the first, second and third power consumption levels.

20. A method for managing power in a cooking platform, the method comprising:

determining a sum of a first power consumption level of a first appliance of the cooking platform, a second power consumption level of a primary element of a second appliance of the cooking platform, and a third power consumption level of an auxiliary element of the second appliance;

determining whether the sum exceeds a power consumption limit of the platform by an amount between the second power consumption level and the third power consumption level;

energizing the primary and auxiliary elements if the sum does not exceed the power consumption limit.

21. A method in accordance with claim 20 further comprising energizing the primary element and not energizing the auxiliary element if the sum exceeds the power consumption limit.

22. A cooking platform having a power consumption limit, the cooking platform comprising:

a first appliance having a first power consumption level;

a second appliance having a second power consumption level; and a controller coupled to said first appliance and said second appliance, said controller configured to reduce power consumption of one of said first and said second appliance when a sum of the first and second power consumption levels exceeds the power consumption limit, and said controller configured to determine whether the sum exceeds the power consumption limit by an amount between a third power consumption level of an element of said second appliance and a fourth power consumption level of another element of said second appliance.

23. A cooking platform in accordance with claim 22 wherein to reduce power consumption of one of said first and said second appliance said controller configured to reduce power consumption by turning off an element of one of said first and second appliance when a sum of the first and second power consumption levels exceeds the power consumption limit.

24. A cooking platform in accordance with claim 22 wherein said first appliance is one of an oven and a surface heating element.

25. A cooking platform in accordance with claim 24 wherein the oven is one of a speedcooking oven and a convection oven and said second appliance is an oven.

* * * * *